United States Patent [19]

Habegger

[11] 4,406,396

[45] Sep. 27, 1983

[54] METHOD AND APPARATUS FOR REGULATING FLUE DRAFT

[76] Inventor: Millard A. Habegger, 5280 Sun Dial Pl., Boulder, Colo. 80301

[21] Appl. No.: 133,037

[22] Filed: Mar. 24, 1980

[51] Int. Cl.[3] ..... G05D 23/12

[52] U.S. Cl. ..... 236/1 G; 236/93 R; 431/20; 126/293

[58] Field of Search ..... 236/1 G, 93 R; 431/20; 126/117, 112, 293, 312, 286, 293; 237/5 S; 98/58; 110/163, 147

[56] References Cited

U.S. PATENT DOCUMENTS

| | | | |
|---|---|---|---|
| 4,095,514 | 6/1978 | Roy et al. | 98/58 |
| 4,251,024 | 2/1981 | Feinberg | 236/1 G |
| 4,262,843 | 4/1981 | Omori et al. | 431/20 |

FOREIGN PATENT DOCUMENTS

| | | | |
|---|---|---|---|
| 2642127 | 3/1978 | Fed. Rep. of Germany | 126/117 |
| 432472 | 7/1935 | United Kingdom | 236/93 R |
| 1045713 | 10/1966 | United Kingdom | 431/20 |

*Primary Examiner*—Albert J. Makay
*Assistant Examiner*—Henry Bennett
*Attorney, Agent, or Firm*—O'Rourke & Harris

[57] ABSTRACT

Method and apparatus for regulating the flue draft in heating systems including a combustion volume, a flue communicating with the combustion volume, and a vent opening between heated ambient air and the flue, the regulation being accomplished by sensing the flow of air through the vent into the flue, and modulating the setting of a downstream damper to maintain such flow at a predetermined, positive but minimal value. A particularly preferred embodiment includes a temperature sensor positioned at the flue side of the vent and connected to a control system to maintain the damper at such a position that the temperature at such location is at a predetermined value above that of the ambient air temperature, and thus indicative of flow of ambient air into the flue at minimal values approaching incipient spillage of combustion gases at the vent.

25 Claims, 7 Drawing Figures

METHOD AND APPARATUS FOR REGULATING FLUE DRAFT

The present invention relates generally to method and apparatus for regulating heating systems, and more particularly to a method and apparatus for modulating the flue gas flow rate during operation of the heating system to decrease heat losses and increase efficiency of the heating system.

DESCRIPTION OF THE RELATED ART

Various heating systems, i.e., those utilizing wood, coal, oil or gas, display individual requirements and construction. For instance, except for gas fired systems, closed or sealed flue systems are feasible. Closed systems typically require a control of some manner to regulate the draft over the combustion products to a reasonable range. Particularly in the case of wood or coal, an excessive draft, such as would occur after operation of the heating system for an extended period of time with accompanying heating of the flue and chimney, would induce an excessive combustion rate. On the other hand, the flue draft must be adequate to remove the combustion products under unfavorable conditions, i.e., elevated ambient temperatures, high moisture, initial operation of the heating system, low barometric pressure etc. Accordingly, it has been the practice to design a flue and chimney arrangement such that the draft is adequate when conditions are most unfavorable, and modulate the draft to the fire or combustion zone by opening a mechanical, swinging damper on the flue to admit ambient air thereto. Ambient air mixed with the combustion product gases cools the flue gases, and increases the flow volume thereby satisfying the chimney draw without generating an excess draft over the fire or combustion zone. However, it will be recognized that substantial amounts of heated ambient air are thus lost from the volume to be heated, and necessarily replaced by the outside air of a lower temperature. In extreme instances, such as a conventional fireplace, the heat loss through the system may well exceed the heat contribution from the system.

In the case of gas fired heating systems, and in the instance of certain oil fired arrangements, another important factor is involved. Combustion products from gas burners are under pressure and must be completely combusted regardless of the draft condition in the flue in order to avoid a hazardous explosive condition. Thus, the flue is vented to the surrounding ambient air by a universally used draft hood. Basically, the draft hood constitutes a vent positioned obliquely to the normal path of travel of combustion of gases. Since the combustion gases must make a substantial excursion in the normal path of travel to reach the vent, spillage of combustion products from the draft hood does not normally occur. However, with a fixed, constantly open vent between the flue and heated ambient air in the form of a draft hood, there is no efficient manner to regulate the draft through the combustion zone. While systems exist to close a damper downstream of the draft hood when the heating system is not operating to minimize heat losses during such period, substantial losses through the draft hood as well as other inefficiencies due to excess draft occur during operation. As with other systems, the flue and chimney are designed to provide at least adequate draft under the most unfavorable conditions, and thus provide excess draft under more favorable conditions. The draft hood reduces the effect of excess draft on the flow through the combustion zone since ambient air enters the draft hood to reduce draft at the combustion chamber. In spite of the draft hood, with excess draft the combustion products and other heated gases flow more rapidly through the typical heat exchanger at a reduced temperature and thus inefficiently transfer sensible heat to the medium, i.e., air, water, etc., utilized to carry heat from the system to, for instance, the interior of a structure. Further, rather substantial amounts of heated ambient air are lost through the flue to again be replaced by cold, outside air.

In the case of wood and coal heating systems, sealed flues using mechanically balanced dampers may be employed to control the flow of heated ambient air into the flue, and thus control the flow through the combustion zone. A more sophisticated arrangement of a thermostatic draft regulater can be found in U.S. Pat. No. 2,311,408, but this arrangement is suitable only for a sealed system in which the draft into the combustion zone is, for instance, controlled by a damper upstream of a vent to the heated ambient air.

Quite a number of arrangements to automatically close a damper in the flue during periods of inactivity are known. U.S. Pat. Nos. 4,017,024 and 4,143,811 are illustrative of such teachings. However, the damper in such systems effectively operates only in on/off cycles, with the flue completely closed when the heating cycle is not active, and, fully open when the heating cycle is active. This of course avoids heat losses during the inactive portion of the cycle, but does nothing to avoid the substantial losses at the draft hood, or diverter, during the active portion of the cycle. Such systems often rely upon temperature sensors in the flue to establish the presence or absence of combustion products, but basically rely upon such measurements to avoid closing the damper during an operative portion of the cycle while heated flue gases are still present.

Another interesting arrangement is that of U.S. Pat. No. 4,159,078 in which bimetallic elements support a coaxial damper member in the flue. Essentially, since the bimetallic elements are located in the main flow of combustion products, this arrangement again is an on/-off device that rapidly responds to temperature changes to close the flue during inactive periods, and rapidly open the flue during activation of the heating cycle.

Thus, it is clear that many of the related art devices operate by merely fully opening the flue damper during combustion periods. This of course does nothing to limit the heat loss to the atmosphere by way of the chimney during operation of the system. U.S. Pat. No. 4,114,805 is a related patent which recognizes this loss. As discussed in the patent, a typical heating installation having a combustion gas temperature of 550° F. in the heat exchanger, has a temperature of 505° F. in the chimney. Clearly great amounts of heat are lost in the chimney. U.S. Pat. No. 4,114,805 discloses a damper assembly which utilizes a bimetallic temperature sensitive means to fully open the damper during periods of low temperature in the flue, and to "close" the damper when the flue temperatures are high. Since the patented damper does not fully close but merely restricts the flue under high temperature conditions, flow of combustion gases is restricted thereby enhancing useful heat exchange by increasing the retention time of hot combustion gases in the furnace. However, in the instance of a heating system using a draft hood, such as a gas furnace, clearly the damper would be downstream of the draft hood. Further, the temperature of the gases in the flue downstream of the damper may well be low even under most inefficient operation by induction of great amounts of heated ambient air through the draft hood into the flow of combustion gases. In such an instance, the patented damper would be fully open, i.e., responding to low flue gas temperatures, thereby enhancing even greater flow of ambient air and lower stack temperatures while further accelerating the flow of hot gases from the combustion zone to the chimney stack.

Thus, while the related art teachings recognized the substantial losses of heat through the flue and chimney both during operation of a heating system as well as while a heating system is inactive, the only effective related art suggestion is to fully close a damper during inactive periods when hot gases are not present. Particularly in the almost ubiquitous situation in which the heating system includes a vent in the form of a diverter or draft hood, effective dampening as a function of stack temperatures cannot be accomplished because the stack temperatures may well be determined by induced flow of heated ambient air through the draft hood—a most inefficient mode of operation—and thus be low while rapidly flowing the hot combustion products through the heat exchanger.

SUMMARY OF THE INVENTION

The present invention, which provides a heretofore unavailable improvement in the regulation of combustion gas flow, comprises a method and apparatus in which the rate of flow of combustion gases is controlled as a function of collateral flow of ambient air through a vent upstream of a damper. The damper is regulated to retard combustion gas flow such that inducement of ambient air through the vent is minimal but positive in direction from the ambient air to the stack. By providing an essentially quiescent area at the vent, heated gases from the combustion zone are retarded in flow for purposes of heat exchange. Additional retardation would cause spillage of the combustion gases from the vent, an undesirable condition, while less retardation would exhaust such gases and induce ambient air flow at an excess rate with accompanying loss of heat energy. While the minimal flow through the vented area may be measured by various sensors, i.e., wand flowsensors, sensors for combustion products, etc. by far the more preferable approach is to measure the temperature immediately on the stack side of the vent and maintain such temperature somewhat above the ambient temperature. Thus the temperature of the vent opening is influenced by the combustion gases, but the temperature is maintained well below the temperature of the combustion gases to preclude actual spillage of such gases. Clearly the temperature of such volume will rise as the downstream damper is closed, thereby impeding flow of combustion gas, and the temperature will fall as the downstream damper is opened to enhance flow of combustion gases and accordingly induce greater flow of heated ambient air through the vent.

Accordingly, an object of the present invention is to provide a new and improved method and apparatus for retaining heated combustion gases within a furnace for optimum utilization of the heat therein.

Another object of the present invention is to provide a new and improved method and apparatus for minimizing the flow of ambient air through a diverter, or other vent, communicating between ambient air and the flow of stack gases.

Yet another object is to provide a new and improved method and apparatus for regulating the flow of stack gases from a heating system to an optimum level, while maintaining the ability to fully close the stack flow channel during periods of inactivity.

These and other objects and features of the present invention will become apparent from the following description.

DETAILED DESCRIPTION OF THE DRAWINGS

Figure 1:
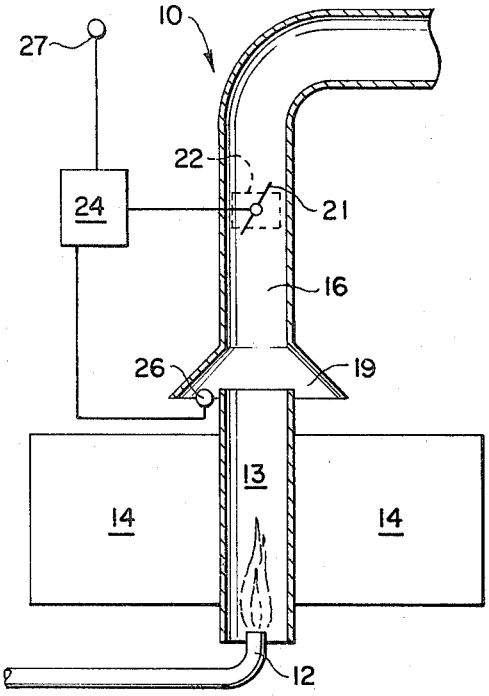
FIG. 1 is a simplified essentially symbolic view of a heating system utilizing a back draft diverter and incorporating a flue draft control system in accord with the instant invention.

Turning now to the drawings, wherein like and similar components are designated by like reference numerals throughout the various figures, heating systems incorporating the concept of the present invention are shown in FIGS. 1 through 4 and generally designated 10. With specific reference to FIG. 1, simplified heating system 10 includes a burner 12, such as is suitable for combusting gas fuel, positioned adjacent to and below heat exchanger 14 illustrated in simplified fashion. Flue 16, communicates with and receives the combustion products from burner 12 and is vented to the ambient air, at draft hood 19. Draft hood 19 is located in such a manner as to require a substantial change in direction of the flow path of the combustion products from burner 12 to flue 16 to actually vent such products at draft hood 19. Flue damper 21, and drive system 22 are located downstream of back draft hood 19. Damper drive system 22 is suited to accurately position flue damper 21 in response to a signal from control means 24. Of critical importance to the invention is the position of heat sensor 26 at the opening of back draft hood 19 to the ambient atmosphere. While broadly the instant invention involves the measurement of and maintenance of a slight flow from the ambient air through draft hood 19 to flue 16, in the preferred embodiment, as is specifically discussed, such air flow is measured by heat sensor 26. Heat sensor 26 is located immediately within draft hood 19, i.e., at a position substantially isolated from the main flow of combustion products from burner 12 and similarly isolated from direct radiation from burner 12. Given the elevated temperature of the combustion products entering draft hood 19 from burner 12, and the relatively low flow of air into draft hood 19 from the surrounding atmosphere, conduction of heat from the flow of combustion products, in conjunction with mild radiation effects from the interior of draft hood 19, will tend to heat the air entering draft hood 19 from the surrounding atmosphere. It is desired that the temperature at heat sensor 26 be somewhat above that of the surrounding ambient air, i.e., up to about 25° C., but preferably 6° to 12 ° C., substantially below the temperature of the combustion products. Accordingly, in the embodiment of the invention of FIG. 1, the temperature of the ambient air is measured by heat sensor 27, which is located remote from heating system 10 in contact with the ambient air, and the temperature of heat sensor 26 is maintained somewhat above such ambient air temperature. This is accomplished by modulating the position of flue damper 21 to restrict flow through flue 16 such that only a relatively minor amount of ambient air is induced to flow into draft hood 19. In the event that flue damper 16 is overly opened, the draw through flue 16 is enhanced and substantial amounts of air will be induced through draft hood 19, thereby lowering the temperature at heat sensor 26 below the predetermined desirable temperature, and, through control means 24, causing damper drive system 22 to close flue damper 21 somewhat to thus restrict the flow through flue 16. On the other hand, should flue damper 21 be overly closed to excessively restrict the flow through flue 16, combustion products from burner 12 will tend to back up and cause heat sensor 26 to reach a temperature above the predetermined desired level, thereby causing control means 24 to activate damper drive system 22 to open flue damper 21 and thus reestablish the desired temperature level at heat sensor 26. When heat sensor 26 is at the desired temperature range, relatively small volumes of ambient air are induced in the draft hood 19, but at such a low flow rate that induced air is heated somewhat above its ambient temperature at heat sensor 26 by the combustion products from burner 12. It will be recognized that the closed loop control system between the heat sensor 26 and flue damper 16 is such to provide for maintenance of this desirable condition.

When only small amounts of ambient air are induced into draft hood 19, the combustion products from burner 12 are maintained in contact with heat exchanger 14 for an optimum period permitting extraction of greater amounts of heat energy for useful purposes and minimizing heat losses of excessively hot combustion products through flue 16. Also, substantial heat loss by exhausting heated ambient air by means of induced flow through draft hood 19 are minimized. Substantial gains in effiency and avoidance of heat loss are accomplished by this means. It should be recognized that positioning heat sensor 26 within the main flow of flue 16 would not be effective since, at positions downstream of draft hood 19 the temperature of the flue gases could be quite low as a result of great amounts of ambient air being induced into draft hood 19. Thus, while the temperature within flue 16 could be low, the operation of heating system 10 would be very inefficient.

Figure 2:
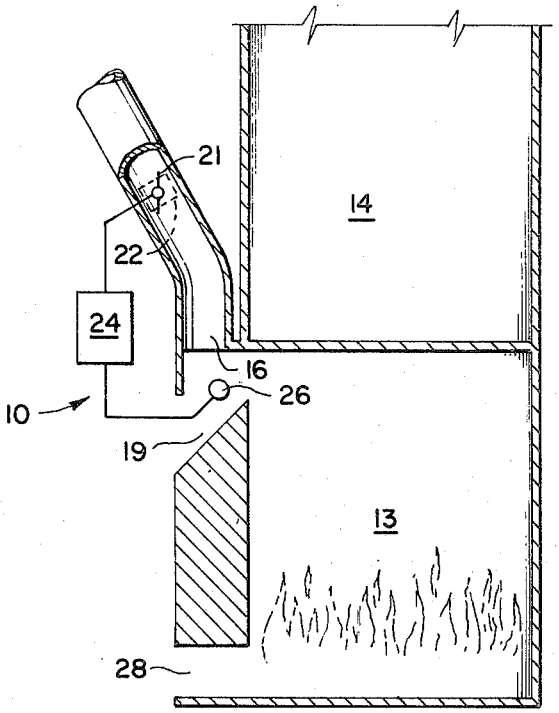
FIG. 2 is similar to FIG. 1 illustrating a somewhat more basic embodiment of the draft control system with yet another type of heating system.
Figure 3:
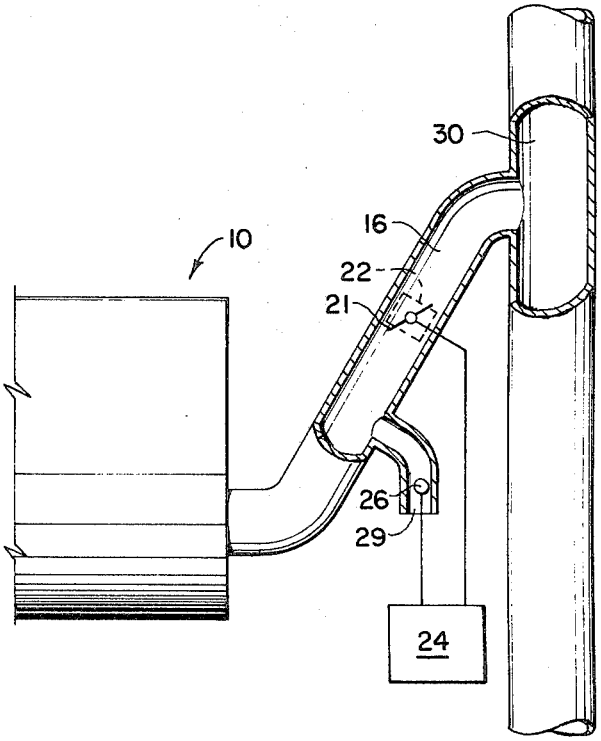
FIG. 3 is again another heating system illustrated in the manner similar to that of FIGS. 1 and 2 and incorporating the flue draft control system of the instant invention.
Figure 4:
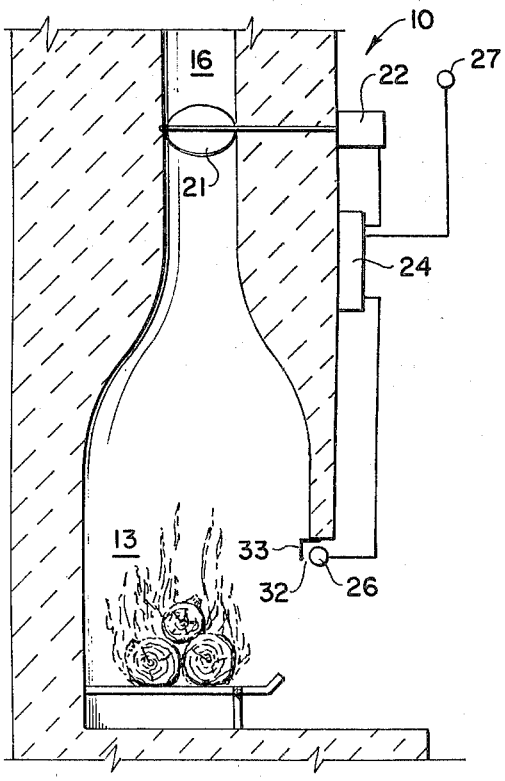
FIG. 4 is a simplified side view of a fireplace including the draft control system of the instant invention.

FIGS. 2, 3, and 4 illustrate variations upon the preferred and more detailed embodiment of FIG. 1. As shown in FIG. 2, combustion volume 13, which may utilize various fuels such as oil, coal or wood, communicates with combustion air inlet 28, and, in a manner similar to heating system 10 of FIG. 1, employs heat exchanger 14, flue 16, draft hood 19, flue damper 21, damper drive system 22, and control means 24 in conjunction with heat sensor 26 to accomplish essentially the identical desirable results of heating system 10 described above with reference to FIG. 1. However, in the instance in which the ambient air is at a relatively constant temperature, heat sensor 27 may be dispensed with since the signal from such heat sensor would be constant. Instead, a fixed rather than relative threshold for comparison of the signal from heat sensor 26 is utilized. In any event, heating system 10 of FIG. 2 again maintains a small flow of ambient air through draft hood 19 to flue 16 by regulating the position of flue damper 21 in the manner described above.

Heating system 10 of FIG. 3 is again functionally equivalent to that of FIGS. 1 and 2, utilizing the single heat sensor 26 embodiment, but incorporates a simple vent 29 in place of the more substantial opening of draft hood 19 as utilized in heating system of FIGS. 1 and 2. Chimney 30 is illustrated to show in a simplified manner the relationship between combustion volume 13, flue 16 and chimney 30. Since vent 29 is quite small relative to hood 19, damper 21 regulates the effective draft through the combustion zone.

Finally, with reference to FIG. 4, the invention is illustrated with reference to a heating system 10 in the form of a fireplace. While a fireplace may of course utilize a heat exchanger, a less efficient embodiment without a heat exchanger is shown. As before, combustion volume 13 is positioned adjacent the opening to the ambient air, which in this instance is adjacent to upper opening 32 of the fireplace with heat sensor 26 positioned at the vent. If some shield from radiant energy from combustion volume 13 is provided for heat sensor 26, heat sensor 26 may be at opening 32 proper. Again, flue damper 21 is regulated in flue 16 to provide for a predetermined temperature at heat sensor 26 such that combustion products are maintained within flue 16 for the maximum period of time without spilling such products through opening 32. While such retention of the combustion products is of course much more effective in the case of a heat exchanger, in any event the draft to combustion volume 13 is minimized, loss of heated ambient air is minimized and the rate of consumption of fuel is minimized.

Figure 5:
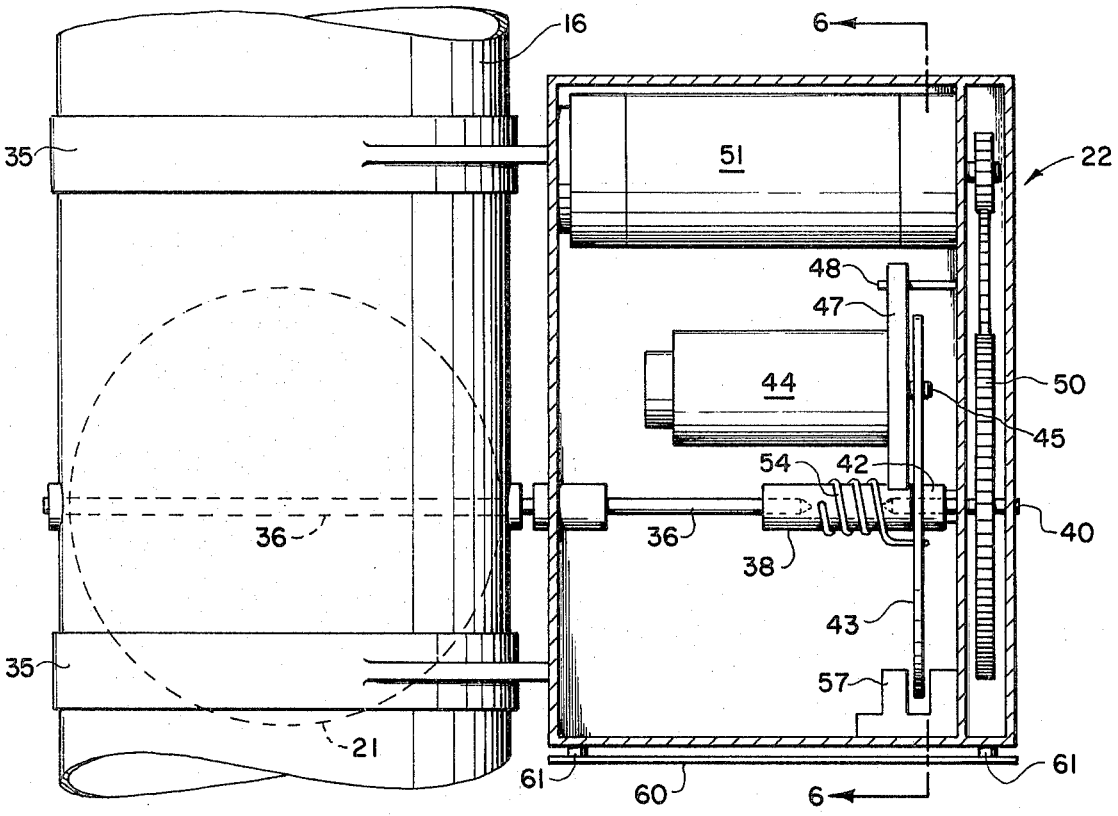
FIG. 5 is a more detailed view of a damper assembly suitable for use with the control system of the instant invention.
Figure 6:
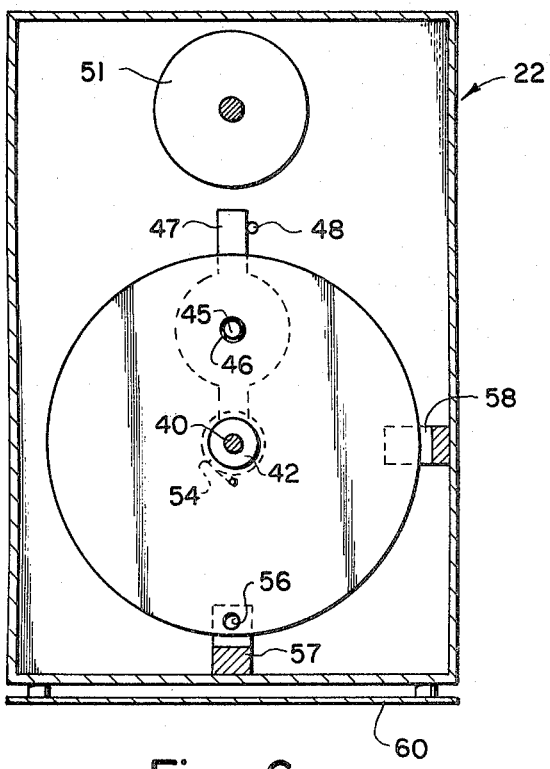
FIG. 6 is a crossectional view of the damper assembly of FIG. 5 along section line 6—6.

An example of a damper drive system 22 is illustrated in FIGS. 5 and 6, though it is to be understood that a number of means may be employed, including bimetal coils and heating means. The illustrated example utilized supports 35 to attach drive system 22 to flue 16. Damper 21 is carried on damper shaft 36 pivotally mounted in flue 16 and extending axially into drive system 22 whereat damper collar 38 is carried on shaft 36. Drive shaft 40 carries drive collar 42 and is axially aligned with damper collar 38. The terminus of drive shaft 40 is rotatably carried in damper collar 38 to serve as a pilot shaft therein. Drive wheel 43 is secured to drive collar 42 while solenoid 44, including spring retractable solenoid pin 45 engaging hole 46 in drive wheel 43, is carried on arm 47 which in turn is attached at damper collar 38. Limit member 48, fixedly attached, engages arm 47 when flue damper 21 is in the open position.

Drive shaft 40 carries the gear at one end of gear train 50, while drive motor 51 is operably connected to the other end gear of gear train 50. While typically gear train 50 includes a theoretical torque amplification of about 1300 between drive motor 51 and drive shaft 40, wide variations may occur depending on the specific characteristics of the system, and particularly of drive motor 51. As will be discussed below, drive motor 51, when activated through gear train 50, positions drive wheel 43, and through arm 47, drives damper shaft 36 to in turn position flue damper 21. In the event of power failure, spring loaded pin 45 retracts from hole 46 in drive wheel 43, thereby allowing spring 54, which is preloaded, to rotate damper collar 38 and attached damper shaft 36 to maintain flue damper 21 in the fail-safe open position.

Drive wheel 43 has defined therein an opening 56, which aligns with optical sensor 57 when flue damper 21 is in the open position, and with optical sensor 58 when flue damper 21 is in the closed position. Control means 24, which will be described in more detail with reference to FIG. 7, may be conveniently mounted on the exterior of damper drive system 22 at mounting board 60, which is mounted on standoffs 61 to provide a measure of heat insulation.

Figure 7:
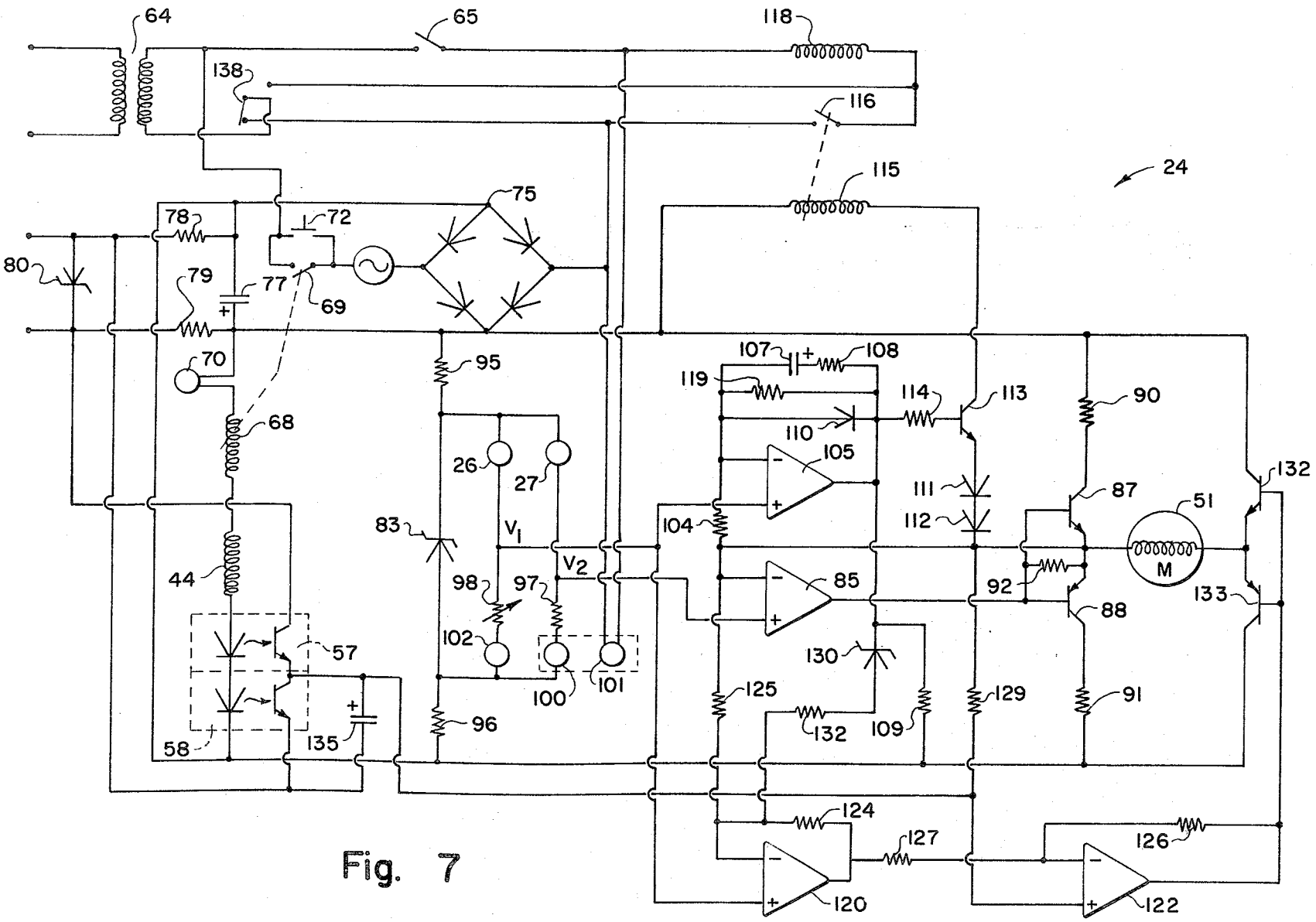
FIG. 7 is a schematic view of control circuitry suitable for use with the instant invention.

Operation of control means 24 will be described with reference to FIG. 7. As illustrated and described, control means 24 includes a number of optional and/or redundant safety measures which may be utilized or dispensed with depending upon the specific environment. Also, as will be apparent to those skilled in the art, the specific control means 24 may be utilized with or without a thermostatic input, though in keeping with a more comprehensive disclosure discussion, will be directed towards a system including such a unit. Thus, transformer 64, which may be connected to ordinary line voltage at one side, serves to step down the voltage to about 24 volts, and is in turn connected to thermostat 65. In the event thermostat 65 is omitted, an applicance, such as a fireplace, when brought to operating temperature will activate control means 24 as the threshold temperature differential is sensed by thermistor 26.

In certain applications, such as in a water heater, an automatic gas shutoff may be employed. The shutoff (not illustrated) is a valve biased to return to the closed position but maintain in an open position by solenoid 68 and including a switch 69 which opens in the event solenoid 68 is unlatched. Thermistor 70, which is a positive temperature coefficient device, is mounted at the base of draft hood 19, and restricts the current to solenoid 68 in the event of excess temperatures, i.e. on the order of 50° C., thus causing solenoid 68 to unlatch and open switch 69. Solenoid 68 may be set by depressing push switch 72, whereupon switch 69 will be set. In the case of power failure, solenoid 68 will retract and allow the shutoff valve to close. If excessive temperatures occur at thermistor 70 located at draft hood 19, indicating spillage of combustion products, power to solenoid 68 will be curtailed and the shutoff closed.

DC power is supplied to the control circuitry by bridge rectifier 75, in conjunction with capacitor 77, resistors 78 and 79 and diode 80 to provide a DC voltage of about 25 volts, but limited to less than about 30 volts, which functions to drive the control circuitry. Diode 83 establishes a voltage of about 10 volts to power the circuit thermistors.

A control voltage, hereinafter referred to as $V_1$, is established as a function of the temperature of thermistor 26. As described earlier, heat sensor 26 is positioned to determine the temperature at the draft hood 19. Thus $V_1$ varies in accord with the condition of heat sensor 26. A reference voltage, hereinafter referred to as $V_2$, is established as a function of heat sensor 27, which, as described above, is positioned in the ambient air. Heat sensor 27 is coupled to the positive input of operational amplifier 85, which functions as a voltage follower. The output from operational amplifier 85 is connected to the bases of transistors 87 and 88 which are complimentary emitter follower transistors with transistor 87 being an NPN and transistor 88 being an PNP one of which turns on when the other turns off. Resistors 90 and 91 are provided in the collector circuits to minimize the voltage drop on transistors 87 and 88. In this manner, operational amplifier 85 and transistors 87 and 88 provide a low impedance source at voltage $V_2$. The low impedance reference voltage $V_2$ is connected to the negative input of operational amplifier 85 to form a feedback loop including resistor 92.

Resistors 95 and 96 function with diode 83 to provide the 10 volt power to the thermistor while resistor 97, in conjunction with variable resistor 98, determine the $V_1$ and $V_2$ difference with heat sensors 26 and 27 at equal resistances, i.e. when heating system 10 is not operating. Variable resistor 98 is adjusted such that $V_1$ is less than $V_2$ by about 0.15 volts when the heating system 10 is not operating.

Thermistor 100 which has a negative temperature coefficient is mounted in thermal contact with, but electrical isolated from positive temperature thermistor 101 with thermistor 102 completing the bridge and balancing thermistor 100 in the thermistor bridge circuit. Thermistors 100 and 101 serve to initiate operation of the circuit of control means 24 upon closing of thermostat 65. Thermistor 101 is connected across thermostat 65 and transformer 64 to provide a low resistance path when thermostat 65 is open thereby powering thermostat 65 under such conditions. As thermostat 65 closes, thermistor 101 is heated and thus limits power consumed when its temperature reaches about 40° C. In turn, thermistor 101 also heats thermistor 100, whereupon the resistance of thermistor 100 decreases and $V_2$ falls thereby inducing a condition of $V_1$ being greater than $V_2$. In the operation of the circuit, heating of thermistor 100 is analogous to heating of heat sensor 26 at the base of draft hood 19. Thus, upon closing the thermostat 65, an initial delay is provided by the heating of thermistor 100, and, as $V_1$ exceeds $V_2$ a further delay is provided as operational amplifier 105, which is connected through resistor 104 to $V_2$ as an input reference voltage, and operates, in conjunction with capacitor 107, as an integrator. Resistor 108 isolates the output of operational amplifier 105 from capacitor 107 while resistor 109 loads operational amplifier 105 with a resistive load to stabilize operational amplifier 105 while charging capacitor 107. Operational amplifier 105 is connected to clamping diode 110 to preclude a substantial negative output prior to closing of thermostat 65, i.e. when $V_1$ is less than $V_2$. However, when $V_1$ exceeds $V_2$, i.e. when thermostat 65 closes as described above, the output of operational amplifier 105 again charges capacitor 107 thereby increasing the output, overcoming diodes 111 and 112, through resistor 114, turning on transistor 113, powering solenoid 115, and closing switch 116, and thus initiating operation of fuel solenoid 118. Accordingly, the delay resulting from heating of thermistor 100, and charging capacitor 107 prior to turning on transistor 113 by operational amplifier 105, is such to be on the order of about 10 seconds. When there is no output from operational amplifier 105, resistor 119 bleeds the charge from capacitor 107.

During the period of delay, $V_1$ minus $V_2$ being positive, the output of operational amplifier 120 increases and the output of inverter operational amplifier 122 diminishes. Operational amplifier 120 is a voltage follower device with a gain equal to the ratio of resistor 124 to resistor 125, i.e. about 82, while operational amplifier 122 functions as an inverting amplifier of unity gain, i.e. the ratio of resistors 126 and 127. In this manner drive motor 51 is activated to position flue damper 21 in the open position during the delay period, i.e. until photosensor 57 is activated by opening 56 in drive wheel 43 thereby increasing the signal to the positive input of operational amplifier 122 by increasing current through resistor 129 and causing the output of operational amplifier 122 to approximate $V_2$ and thus terminate operation of drive motor 51 with flue damper 21 in the open position. Flue damper 21 will thus be initially opened during the delay period prior to activation of fuel solenoid 118.

With fuel solenoid 118 operable, heating device 10 of course develops combustion products which flow past open flue damper 21 and, concurrently heat heat sensor 26. As heat sensor 26 is heated by the combustion products, the output of operational amplifier 105 also continues to increase as the charge on capacitor 107 increases thereby overcoming diode 130 and through resistor 132 increasing the voltage at the negative input of operational amplifier 120, thus increasing the output of operational amplifier 122 and, through transistors 132 and 133, causing drive motor 51 to initiate closing of flue damper 21. As flue damper 21 closes, the temperature at heat sensor 26 tends to increase thereby increasing $V_1$ and, in turn, increasing the voltage at the positive input of operational amplifier 120 and, according, decreasing the output of operational amplifier 122 again to open flue damper 21 and increase the cooling of heat sensor 26. It should be noted that transistors 132 and 133 constitute a low impedance source for drive motor 51 responsive to the output of operational amplifier 122 and are otherwise analogous to transistors 87 and 88. Accordingly, as the output from transistors 132 and 133 falls below or rises above $V_2$, drive motor 51 will be activated to open or close flue damper 21 and thus regulate the temperature at heat sensor 26. Generally, if heat sensor 26 is held about 15° C. above heat sensor 27, efficient operation of heating device 10 is attained.

When thermostat 65 opens, fuel solenoid 118 terminates the production of heat. Accordingly, heat sensor 26 tends to cool, thereby decreasing $V_1$ and driving flue damper 51 to the closed position. However, $V_1$ diminishes sufficiently slowly to maintain flue damper 21 open while combustion products are exhausted. When flue damper 21 finally closes, opening 56 is positioned to turn on photoresistor 58 to adjust the voltage at output of operational amplifier 122 to about $V_2$, thereby stopping drive motor 51 with flue damper 21 in the closed position. Capacitor 135 is provided at photosensors 57 and 58 to minimize circuit noise.

If operation of control means 24 is not desired, switch 138 may be repositioned to revert to conventional thermostatic control.

Specific implementation and operation of control means 24 will be more readily appreciated with reference to the following component table.

Table of Components

| | |
|---|---|
| Heat Sensors 26 & 27 | Thermistors, negative temperature coefficient, 10K ohms at 25° C., time constant 10 seconds |
| Optical Sensors 57 & 58 | LED and NPN phototransistor units (TIL 138) |
| Transformer 64 | 115 volt to 24 volt AC 40 watts |
| Thermistor 70 | Positive temperature coefficient, switch point 50° C. |

Table of Components-continued

| | |
|---|---|
| Bridge rectifier 75 | 1 amp, 100 volt diodes |
| Capacitor 77 | 100 microfarad, 100 volt electrolytic capacitor |
| Resistors 78 & 79 | 47 ohms, ½ watt |
| Diode 80 | Zener diode, 30 volt, 1 watt |
| Diode 83 | Zener diode, 10 volt, 1 watt |
| Operational Amplifiers 85, 105, 120, & 122 | Each a section of a LM 324 DIP |
| Transistors 87, 113 & 132 | NPN 2N 2219 |
| Transistors 88 & 133 | PNP 2N 2905 |
| Resistors 90 & 91 | 39 ohm, 1 watt |
| Resistors 92, 114 & 125 | 1K ohm, ½ watt |
| Resistors 95, 96 & 132 | 4.7K ohm, ½ watt |
| Resistor 97 | 6.8K ohm, ½ watt |
| Variable resistor 98 | 10K ohm, .5 watt potentiometer |
| Thermistors 100 & 102 | Negative temperature coefficient, 2K ohms at 25° C., 10 second time constant |
| Thermistor 101 | Positive temperature coefficient, switch point 40° C. |
| Resistors 104, 108 & 129 | 47K ohm, ½ watt |
| Capacitor 107 | 22 microfarad, 35 volt Tantalum electrolytic capacitor |
| Resistors 109, 126 & 129 | 22K ohm, ½ watt |
| Diodes 110, 111 & 112 | 75 milliamp, 75 volt PIV (IN 914) |
| Resistor 124 | 82K ohm, ½ watt |
| Diode 130 | 5 volt, ½ watt Zener diode |
| Capacitor 135 | 6.8 microfarad, 50 volt Tantalum electrolytic capacitor |

In summary, the instant invention concerns a method and apparatus for monitoring vent air flow from surrounding air into the flue, typically at the draft hood, of a heating device and adjusting a flue damper downstream of the vent such that a low but positive flow through the vent into the flue is maintained. Preferably the flow is monitored by a temperature sensor which may adjust the flue as a function of the absolute temperature at the sensor, or which may adjust the flue damper as a function of the relative temperature at the vent with regard to a second temperature sensor positioned in the ambient air adjacent the heating device. By maintaining a modest but positive flow through the vent, only limited amounts of heated air are lost from the surroundings through the flue, and the apparatus and method preferably closes the flue damper entirely when the heating device is not operating. In most instances, in addition to the substantial savings with regard to loss of heated air flowing from the surroundings through the vent and thus through the flue, the heat transfer efficiency from the combustion products and air to the heat transfer medium utilized in most heating devices may be improved by retarding flow through the heat transfer area to the flue. Thus, when a heating device is operated in accord with the instant invention, the conventional excess chimney draft is moderated by the flue damper, and optimum or near optimum operating conditions are maintained with regard to flow of air through the vent to the flue and flow of combustion products and air heated by combustion through the heat transfer area.

Although in view of wide usage to which the present invention may be put, only limited embodiments of the invention have been described for purposes of illustration, it is, however, anticipated that various changes and modifications will be apparent to those skilled in the art, and that such changes and modifications may be made without departing from the scope of the invention as defined by the following claims.

What is claimed is:

1. In a heating device including a combustion zone, a flue to collect combustion products from the combustion zone, and a vent to the surrounding atmosphere defined at a location between the combustion zone and the flue, the improvement comprising;

means positioned at the vent adjacent to but spaced from the flue to sense air flow through the vent;

a damper positioned in the flue downstream of the vent; and means to position the flue damper in response to the air flow sensing means to maintain a predetermined substantially fixed flow of air through the vent and into the flue during combustion in the combustion zone;

whereby airflow from outside the heating device into the flue through the vent may be maintained at desired low but positive rates under differing conditions.

2. A heating device as set forth in claim 1 in which the air flow sensing means comprises a temperature sensor positioned at the vent in a location adjacent to but spaced from the flue whereby the temperature sensor will be indirectly heated by the combustion products while in the air flow through the vent.

3. A heating device as set forth in claim 2 in which the temperature sensor is a thermistor.

4. A heating device as set forth in claim 2 in which a second temperature sensor is positioned in the air adjacent the heating device, and the means to position the damper in response to the air flow sensing means does so in response to a temperature differential between the temperature sensor positioned in the vent and the second temperature sensor.

5. A heating device as set forth in claim 1 in which the vent comprises a draft hood and a temperature sensor comprises the means to sense flow of air through the vent with the temperature sensor being positioned within the draft hood adjacent the inlet thereof.

6. A heating device as set forth in claim 5 in which the means to position the flue damper comprise a motor operably connected to the flue damper and control means connected to the temperature sensor to maintain the temperature sensor at a predetermined level during combustion in the combustion zone.

7. A heating device as set forth in claim 6 which further includes a second temperature sensor positioned in the air surrounding the heating device and in which the predetermined level at which the first temperature sensor is maintained is a predetermined temperature differential relative to the second temperature sensor.

8. A heating device as set forth in claim 6 in which the predetermined temperature at which the temperature sensor is maintained is an absolute temperature of a predetermined level.

9. A heating device as set forth in claim 6 which further includes thermostat means to initiate combustion in the combustion zone, and in which the means to position the flue damper is responsive to operation of the thermostat to terminate combustion to fully close the damper means in the flue.

10. A heating device as set forth in claim 9 in which the means to position the flue damper first fully opens the flue damper upon operation of the thermostat to initiate combustion, and thereafter responds to the temperature level at the temperature sensor.

11. In a heating device including a combustion zone adapted to combust fuel, a flue to duct the combustion products from the combustion zone, and a draft hood having an inlet from the surrounding atmosphere positioned between the combustion zone and the terminus of the flue;

the improvement comprising:

means positioned at the draft hood in a location adjacent to but spaced from the flue to sense air flow from the surrounding atmosphere through the draft hood;

valve means positioned in the flue downstream of the draft hood;

means to drive the valve means to restrict and open flow through the flue; and control means responsive to the air flow means through the draft hood to activate the valve means drive means and position the valve means in a position to establish and maintain a predetermined substantially fixed flow of air through the draft hood to the flue as measured by the air flow sensing means.

12. A heating device as set forth in claim 11 in which the flow means comprise a temperature sensor positioned adjacent the inlet of the draft hood to the flue.

13. A heating device as set forth in claim 12 in which a second temperature sensor is provided in the air surrounding the heating device, and the control means maintains a predetermined temperature differential between the temperature sensor in the opening of the draft hood and the second temperature sensor.

14. A heating device as set forth in claim 11 in which the means to drive the valve means includes means to fully open the valve means in the event of termination of power to the heating device.

15. A heating device as set forth in claim 11 in which thermostat means start and stop combustion in the combustion zone and in which the control means initially opens the valve means fully upon initiation of combustion by the thermostat means, thereafter monitors the air flow into the draft hood to maintain optimum flow to the flue, and finally terminates flow through the flue by closing the valve means upon termination of the combustion by the thermostat means and upon completion of scavenging of the combustion products.

16. A heating device as set forth in claim 11 in which the means to drive the valve means comprises an electric motor operably connected to the valve means by gear train means.

17. A method of operating a heating device including a combustion zone, a flue to collect combustion products from the combustion zone and a vent to the air surrounding the heating device defined between the combustion zone and the end of the flue downstream of the combustion zone, the method comprising;

measuring the flow of air through the vent into the flue during combustion by means of a flow rate sensor positioned at the vent;

positioning valve means damper located in the flue downstream of the vent to restrict flow through the flue to a flow rate which provides a predetermined rate of flow of air through the vent and flue as a result of the flow rate measured; and maintaining the flow of air through the vent into the flue at the predetermined level by repositioning the valve means in response to a change in the measured flow rate at the vent, whereby loss of heated air surrounding the heating device through the vent is minimized and combustion products are retarded in their flow from the heating device to improve efficiency of the heating device.

18. A method of operating a heating device a set forth in claim 17 in which the flow rate sensor means to sense the flow of air through the vent is a temperature sensor, and the temperature sensor is maintained at a predetermined temperature above the temperature of the air flowing into the vent by indirect heating from the combustion products as a function of the predetermined air flow.

19. A method of operating a heating device as set forth in claim 18 in which the temperature of the air surrounding the heating device is measured by a second temperature sensor located in the air surrounding the heating device, and the temperature sensor positioned in the vent is maintained at a predetermined temperature differential relative to the second temperature sensor as a function of the predetermined air flow rate through the vent by adjusting the damper.

20. A method of operating a heating device as set forth in claim 17 in which the damper is positioned by an electric motor activated by control means in response to the measured rate of air flow through the vent.

21. A method of efficiently operating a heating device comprising;

initiating combustion in a combustion zone, substantially fully opening a flue damper positioned in a flue receiving the combustion products from the combustion zone;

measuring the flow rate of the air surrounding the heating device through a vent draft hood positioned between the combustion zone and flue damper and communicating between the surrounding air and combustion products by means of a flow rate sensor positioned at the vent draft hood;

moving the flue damper to a more restrictive position until the measured rate of flow of air through the draft hood is at a predetermined level;

opening the flue damper to a less restrictive position when the measured rate of flow of air through the draft hood falls below the predetermined level to restore the predetermined flow rate of air;

terminating combustion in the combustion zone; and fully closing the flue damper after exhausting the combustion products from the combustion zone and flue.

22. A method of efficiently operating a heating device as set forth in claim 21 in which the flow rate of air through the draft hood is measured by a heat sensor located within the draft hood adjacent the opening therein to the surrounding air.

23. A method of efficiently operating a heating device as set forth in claim 22 in which a second heat sensor is positioned in the surrounding air and the predetermined flow rate of air through the draft hood is established as a function of the temperature differential between the heat sensor in the draft hood and the second heat sensor.

24. A method of efficiently operating a heating device as set forth in claim 21 in which the flue damper is moved by an electric motor operably connected thereto in response to the measured flow rate of surrounding air through the draft hood.

25. A method of efficiently operating a heating device as set forth in claim 21 in which the combustion in the combustion zone is initiated and terminated by thermostat means.

* * * * *